US006325260B1

(12) United States Patent
Gorham

(10) Patent No.: US 6,325,260 B1
(45) Date of Patent: Dec. 4, 2001

(54) ANKLE HOLDER FOR CARRYING CONDOM PACKAGES

(76) Inventor: Glenn R. Gorham, 8724 ¼ Wyngate St., Sunland, CA (US) 91040

( * ) Notice: Subject to any disclaimer, the term of this patent is extended or adjusted under 35 U.S.C. 154(b) by 0 days.

(21) Appl. No.: 09/562,448

(22) Filed: May 1, 2000

(51) Int. Cl.[7] ..... A45F 5/00

(52) U.S. Cl. ..... 224/222; 206/69; 224/223; 224/245

(58) Field of Search ..... 224/219, 222, 224/223, 242, 245; 206/69

(56) References Cited

U.S. PATENT DOCUMENTS

D. 258,246 * 2/1981 Kravchenko ..... D2/383
D. 273,344 * 4/1984 Lee ..... D2/383
1,184,311 * 5/1916 Boch ..... 224/219
4,461,030 * 7/1984 Knudsen ..... 224/222
5,005,695 * 4/1991 Tennefos et al. ..... 206/69
5,141,141 * 8/1992 Leone ..... 224/222
5,314,102 * 5/1994 Roy ..... 224/151
5,332,087 * 7/1994 McMahon ..... 206/69
5,454,185 * 10/1995 Love ..... 43/57.1
5,794,769 * 8/1998 Tomlinson et al. ..... 206/69
5,938,089 * 8/1999 Abreu-Marson ..... 224/148.5

* cited by examiner

*Primary Examiner*—Stephen P. Garbe
(74) *Attorney, Agent, or Firm*—Raymond Y. Chan; David and Raymond Patent Group

(57) ABSTRACT

An ankle holder for carrying condom packages is designed to hold and conceal condom packages to the wearer's ankle, waist, or wrist and is designed to allow the wearer to easily remove a condom package from the ankle holder or to easily open a condom package while the condom package remains in the ankle holder. The ankle holder comprises of a strap which has an adjustable fastening device to shape the strap into a loop and a holder apparatus to releasably hold condom packages to one face of the strap.

3 Claims, 14 Drawing Sheets

ANKLE HOLDER FOR CARRYING CONDOM PACKAGES

BACKGROUND OF THE PRESENT INVENTION

1. Field of Invention

This invention relates generally to condom carriers, and more particularly to an ankle holder for carrying condom packages which not only holds and conceals condom packages to the wearer's ankle, but also allows the wearer to easily remove a condom package from the ankle holder or to easily open a condom package while the condom package remains in the ankle holder.

2. Description of Related Arts

A wallet is the typical article used to carry and conceal a condom package. A significant problem with carrying a condom package in a wallet is that the outline of the condom package is often visible to others when the wallet is used to retrieve additional personal items stored in the wallet like money, credit cards, business cards, personal identification, and photographs. An individual is often subjected to a considerable amount of embarrassment and teasing when others perceive the supposedly concealed condom package in one's wallet. Another problem with using a wallet is that the condom package is difficult to access when one is in the throws of passion. Finding and fumbling around in one's wallet for a condom package can destroy the mood of lovemaking. Using money belt devices are also inadequate solutions to these problems because money belts are not specifically designed to carry condom packages. Since money belt devices are designed to hold items larger than condom packages, locating and retrieving a condom package from a money belt device can be difficult. In addition, most of the time, a money belt must be removed from one's body before the contents of the belt can be removed.

SUMMARY OF THE PRESENT INVENTION

The present invention provides an ankle holder for carrying condom packages, the ankle holder is designed to hold and conceal condom packages to the wearer's ankle, waist, or wrist and is designed to allow the wearer to easily remove the condom package from the ankle holder or to easily open the condom package while the condom package remains in the ankle holder. The ankle holder comprises a strap which has an adjustable fastening device to shape the strap into a loop and a holder apparatus to releasably hold condom packages to one face of the strap. The condom holder apparatus can also include a protuberance which fits through a hole in an edge of a modified condom package.

An advantage of the present invention is that the ankle holder for carrying condom packages effectively conceals the condom packages from the view of others. Because the ankle holder can be worn underneath one's clothing or hidden in a belt, it is unlikely that a person will ascertain that the wearer of the ankle holder is carrying condom packages.

Another advantage of the present invention is that the ankle holder allows for easy retrieval of a condom package. The pockets are designed to expose a portion of the condom packages while still securely holding the condom packages in the pockets. Since condom packages are flexible, a condom package can bend through an opening in the pocket. To remove the condom package from the ankle holder, the wearer may simply reach to the ankle holder hidden under his clothing and tug at a corner or an edge of the condom package. Furthermore, the pockets can include a locking device that releasably secures the condom packages in the pockets. Consequently, the wearer can use one hand to retrieve and open a condom package. The wearer can tear a side or a corner of a condom package with one hand and then retrieve the condom from its package while the condom package remains in the ankle holder. Alternatively, the wearer can just pull on the condom package. Since the locking device secures a portion of the condom package in the pocket, pulling the condom package out of the pocket will result in tearing open the condom package.

Further advantages and embodiments of the present invention may be ascertained from the description of the drawings and the description of the preferred embodiment.

DETAILED DESCRIPTION OF THE PREFERRED EMBODIMENT

The present invention provides an ankle holder 30 for carrying condom packages 40 designed to hold and conceal condom packages on the wearer's ankle.

Figure 1:
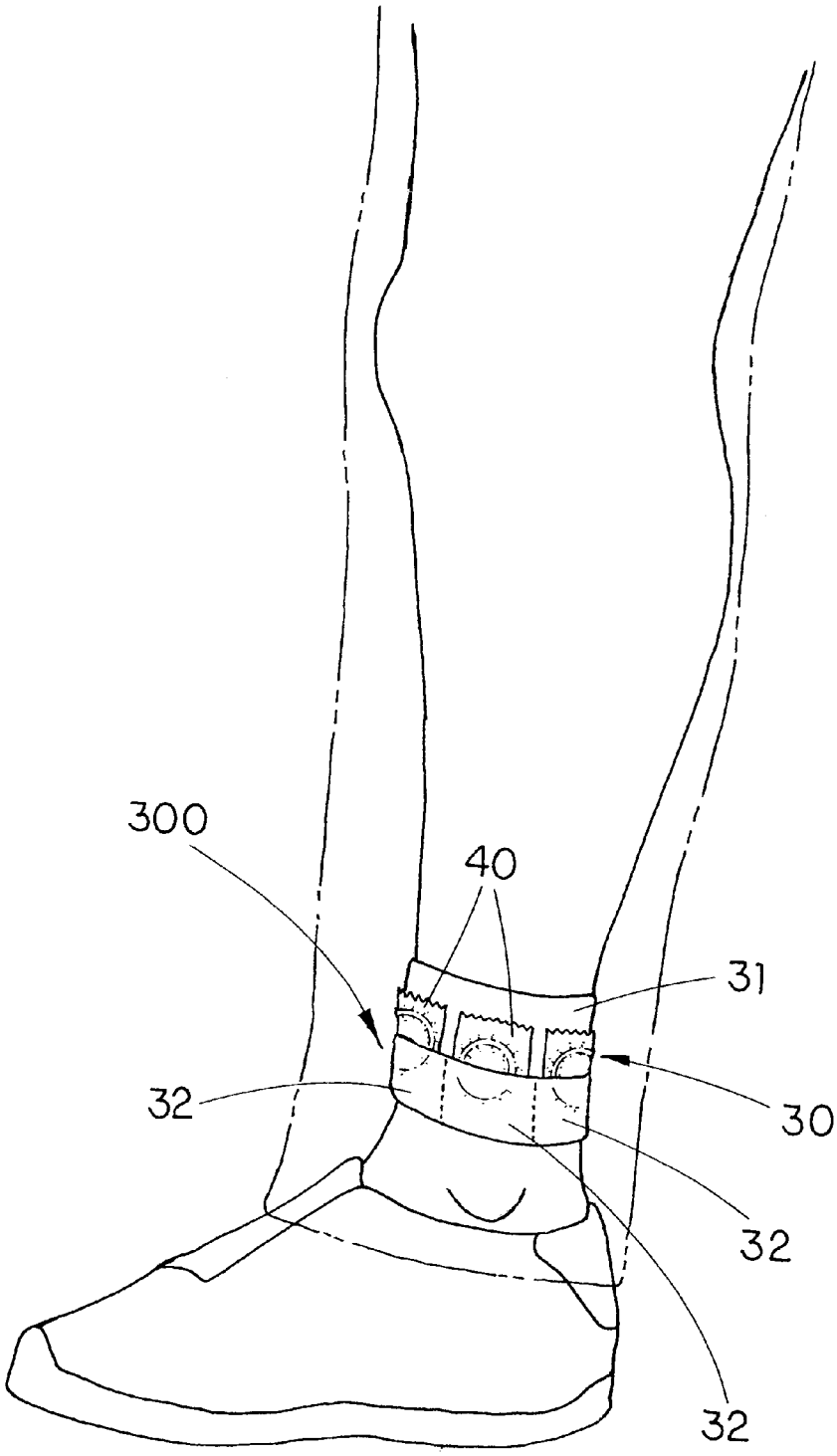
FIG. 1 is a perspective view of the present invention linked around the wearer's ankle.
Figure 2:
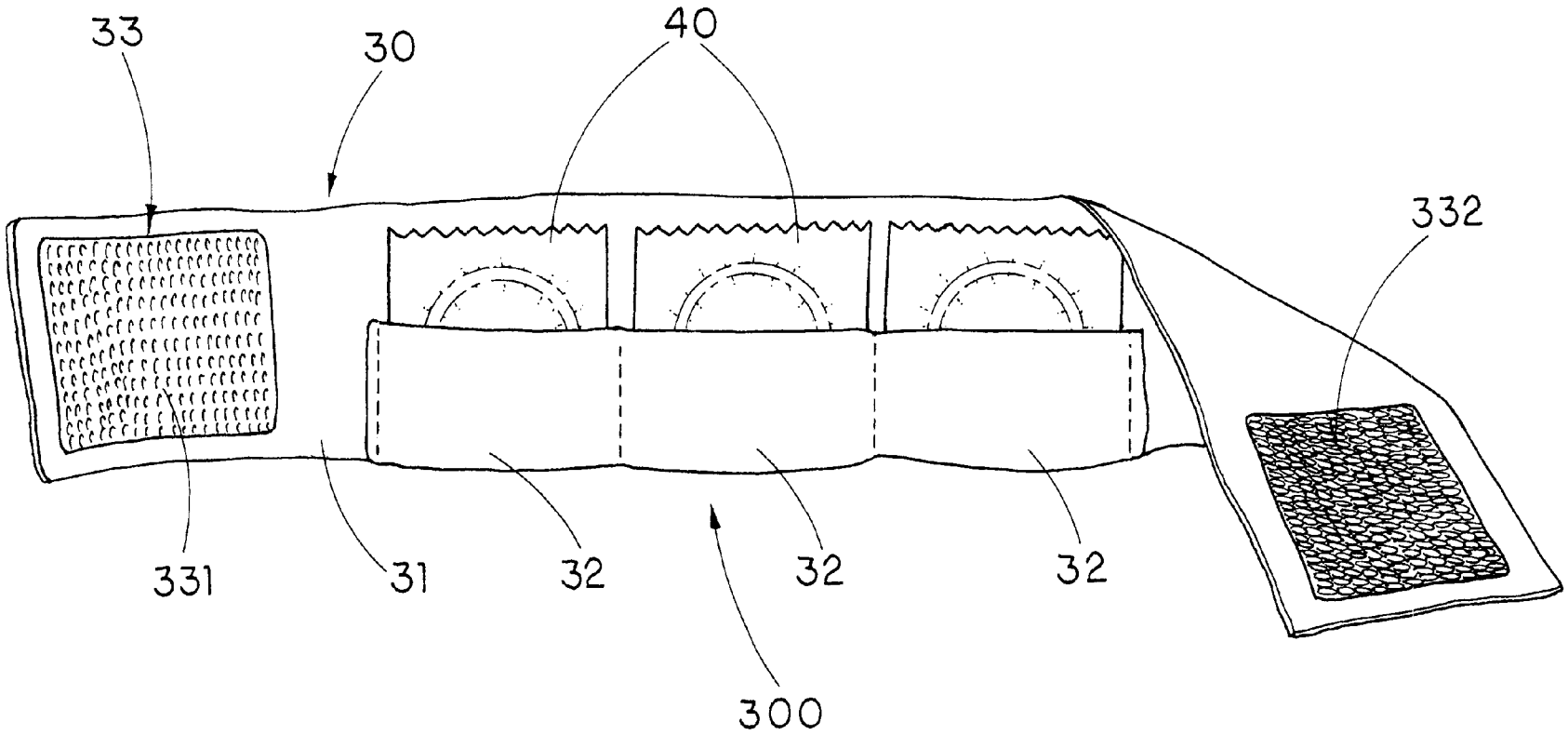
FIG. 2 is a perspective view of the ankle holder according to a preferred embodiment of the present invention.

Referring to FIGS. 1 and 2 of the drawings, a preferred embodiment of the ankle holder 30 for carrying condom packages 40 is illustrated. The ankle holder 30 comprises a flat strap 31. The flat strap 31 may be made of any flexible material, synthetic or natural, such as nylon, polyester, vinyl, neoprene, cotton, wool, leather, and other materials well known to those skilled in the art. The strap 31 has a condom holder apparatus 300 which releasably holds two or more condom packages 40 on one face of the strap 31.

In the preferred embodiment, the condom holder apparatus 300 comprises at least a pocket 32. Preferably, the strap 31 comprises three pockets 32. The strap 31 also has a fastening device 33 which releasably connects the ends of the strap 31 together to form a loop and which also adjusts the length of the strap 31 to fit around the wearer's ankle, waist, or wrist. The fastening device 33 preferably comprises a hook fastener 331 and loop fastener 332 respectively affixed at two ends of the strap 30. However, the fastening device 33 can comprise other fasteners such as buckles, buttons, clasps, clips, or other devices well known to those skilled in the art. FIG. 1 illustrates the ankle holder 30 fastened around the wearer's ankle with the pockets 32 facing away from the wearer's skin. However, the ankle holder 30 can also be worn with the pockets 32 facing toward the wearer's skin.

Figure 3:
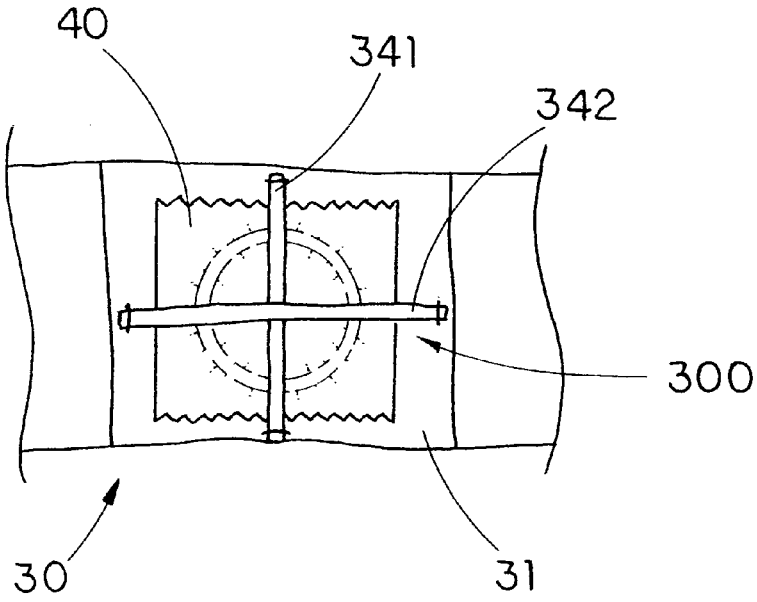
FIG. 3 is a partial front view of the ankle holder illustrating a first alternative mode of the condom holder apparatus according to the above preferred embodiment of the present invention.

The condom holder apparatus 300 can also include elements which both prevent the condom packages 40 from falling out of the ankle holder 30 and allow the wearer to easily remove the condom packages 40 from the ankle holder. As shown in FIG. 3, instead of a pocket, the condom holder apparatus 300 comprises two elastic bands 341, 342. The two elastic bands 341, 342 fit over one of the condom packages 40 and hold the condom package 40 against the inner surface of the strap 31.

Figure 4:
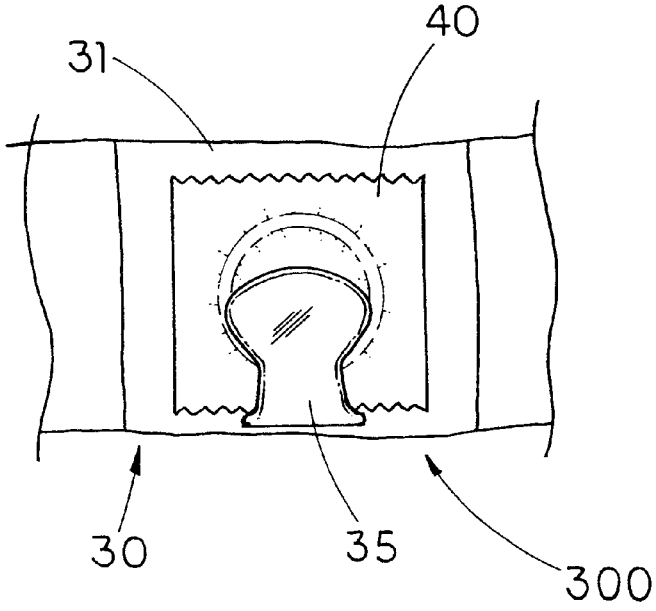
FIG. 4 is a partial front view of the ankle holder illustrating a second alternative mode of the condom holder apparatus according to the above preferred embodiment of the present invention.

Also, instead of a pocket, the condom holder apparatus 300, as shown in FIG. 4, alternatively comprises a clip 35 which holds the respective condom package 40 to the inner surface of the strap 31.

Figure 5:
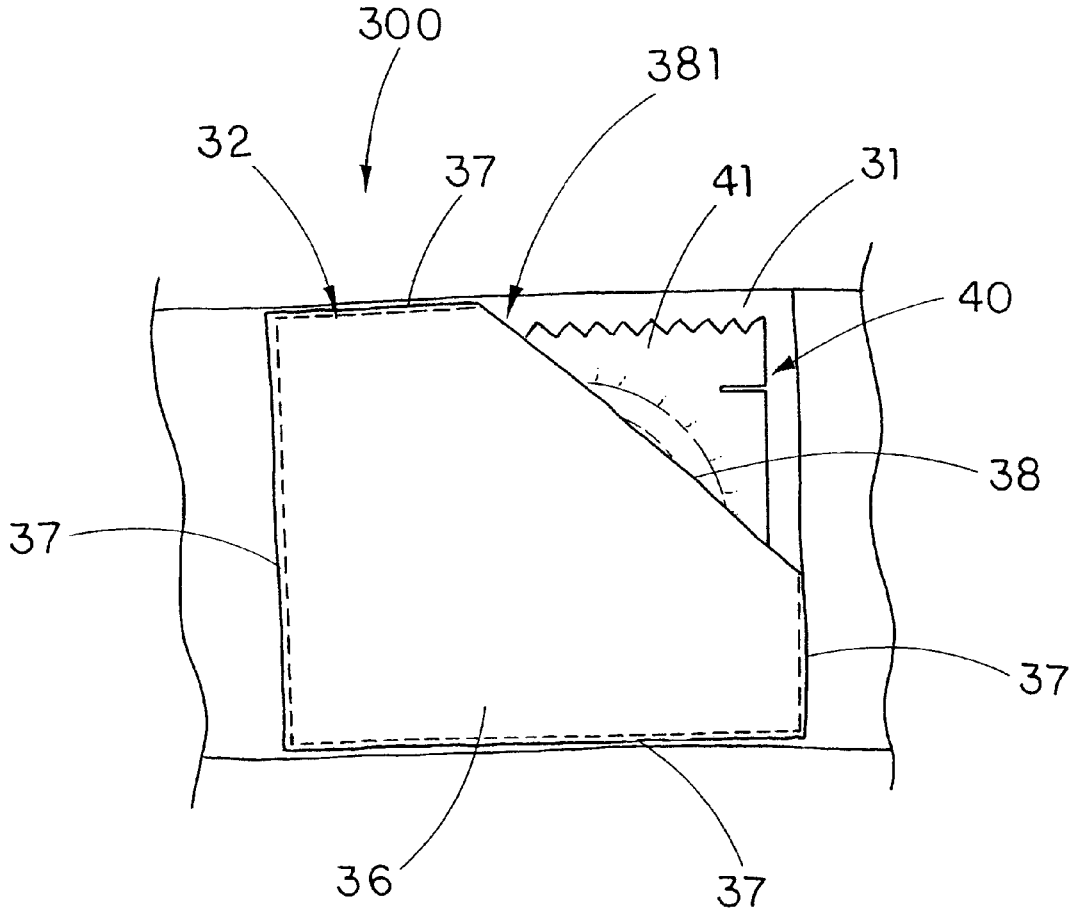
FIG. 5 is a partial front view of the ankle holder illustrating a third alternative mode of the condom holder apparatus according to the above preferred embodiment of the present invention.

However, preferably, as shown in FIG. 5, the condom holder apparatus 300 comprises at least a holder pocket 32 which covers at least two corners of the condom package 40 and exposes a portion of the condom package 40. As shown in FIG. 5, the holder pocket 32 is made up of a panel 36 of flexible material which is shaped as a pentagon. Four sides 37 of the panel 36 are affixed to the strap 31. The corner side 38 of the panel 36, which reveals the corner 41 of the condom package 40, is not fixed to the strap 31 so that the wearer can remove the condom package 40 by pulling the condom package 40 through the opening 381 defined at the corner side 38.

Figure 6:
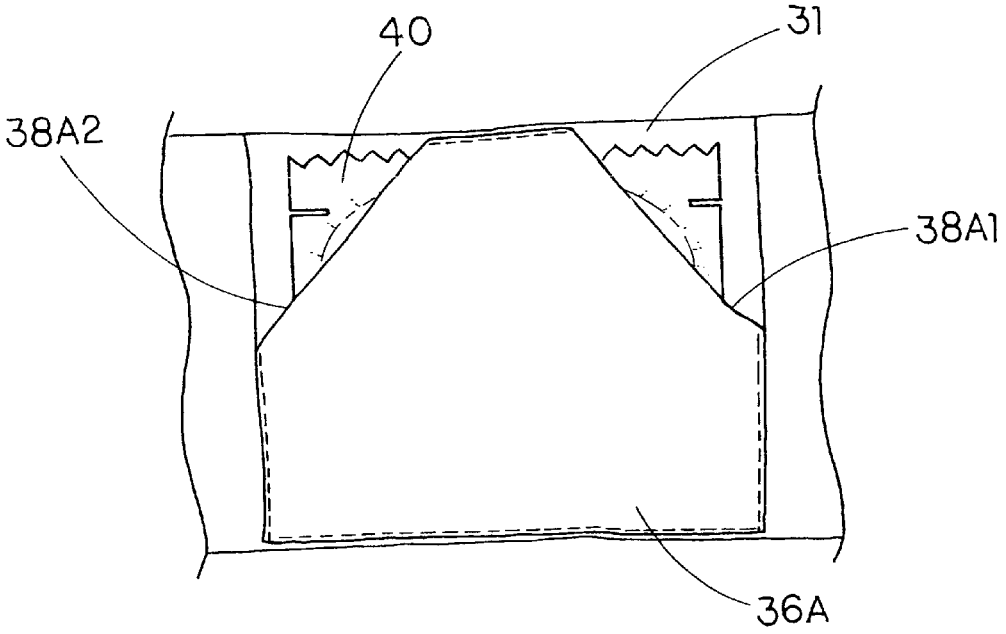
FIG. 6 is a partial front view of the ankle holder illustrating a fourth alternative mode of the condom holder apparatus according to the above preferred embodiment of the present invention.
Figure 7:
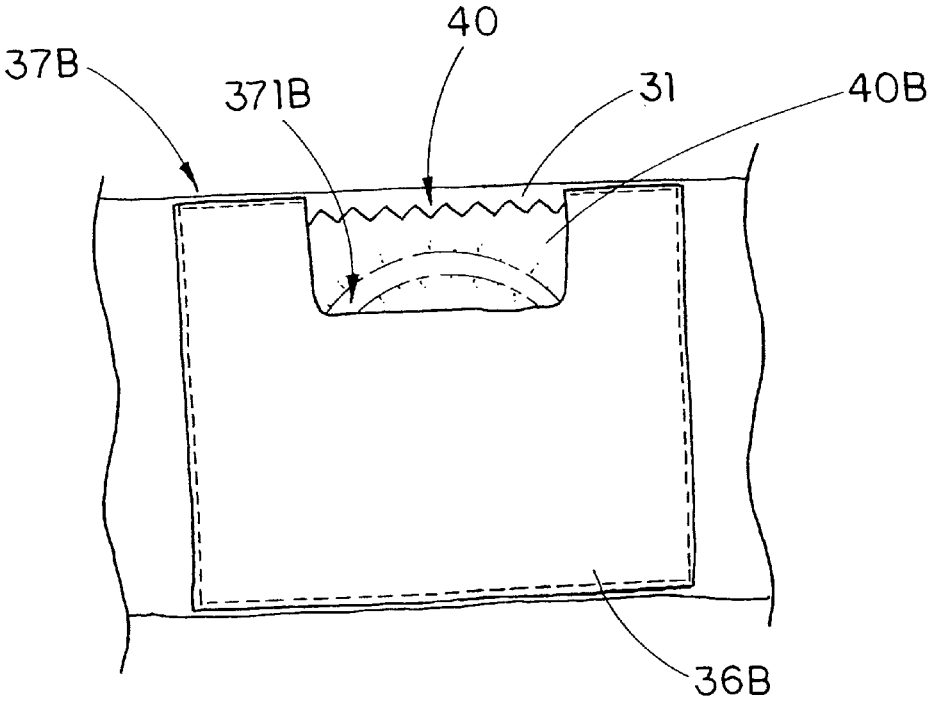
FIG. 7 is a partial front view of the ankle holder illustrating a fifth alternative mode of the condom holder apparatus according to the above preferred embodiment of the present invention.

FIGS. 6 and 7 illustrate a fourth and a fifth alternative modes. The panel 36A reveals two corner sides 38A1, 38A2 of the condom package 40, as shown in FIG. 6. Or that, as shown in FIG. 7, the panel 38B provides a top opening 371B at a top side 37B for revealing a top portion 40B of a condom package 40.

Figure 8:
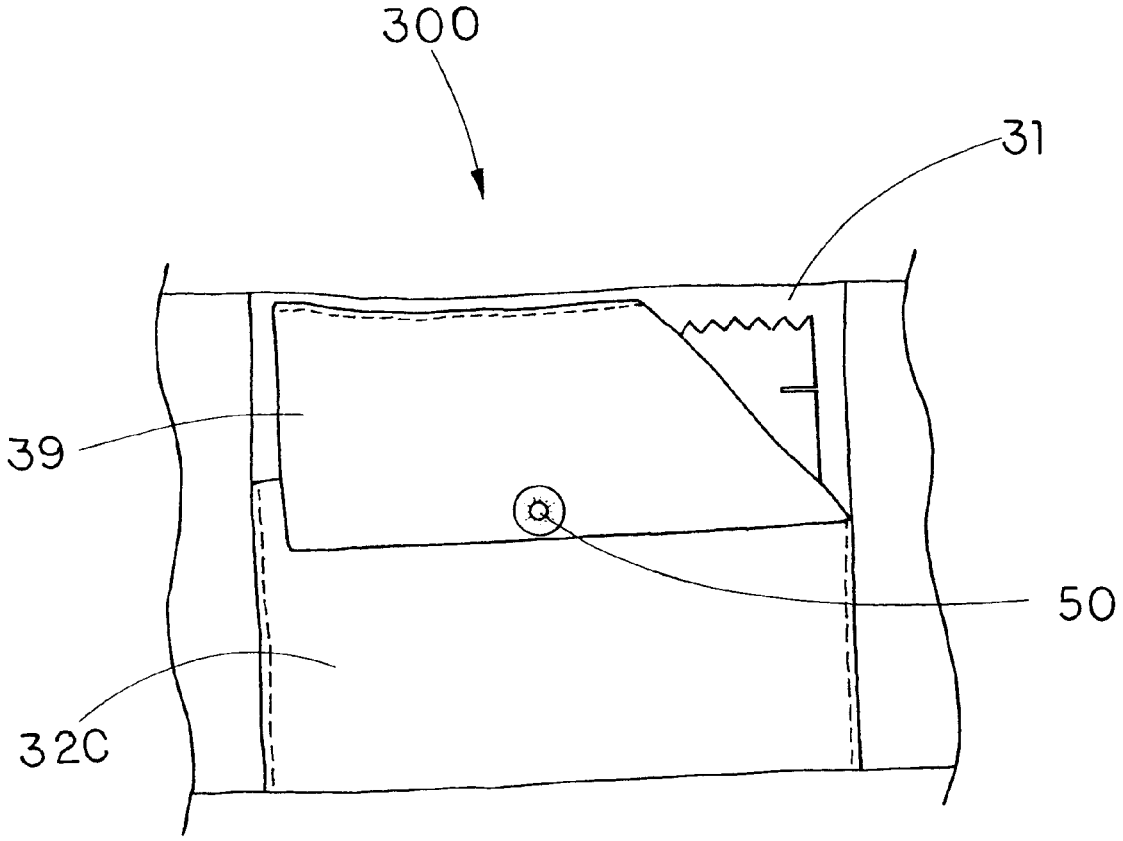
FIG. 8 a partial front view of the ankle holder illustrating a sixth alternative mode of the condom holder apparatus according to the above preferred embodiment of the present invention.

In addition, FIG. 8 illustrates a sixth alternative mode of the condom holder apparatus 300 which comprises at least a pocket 32C having a flap 39. One side of the flap 39 is connected to the strap 31. An attachment device 50 connects the flap 39 to the pocket 32. The attachment device 40 can be a button, a clip, hook and loop fasteners, or other similar attachment elements.

Figure 9:
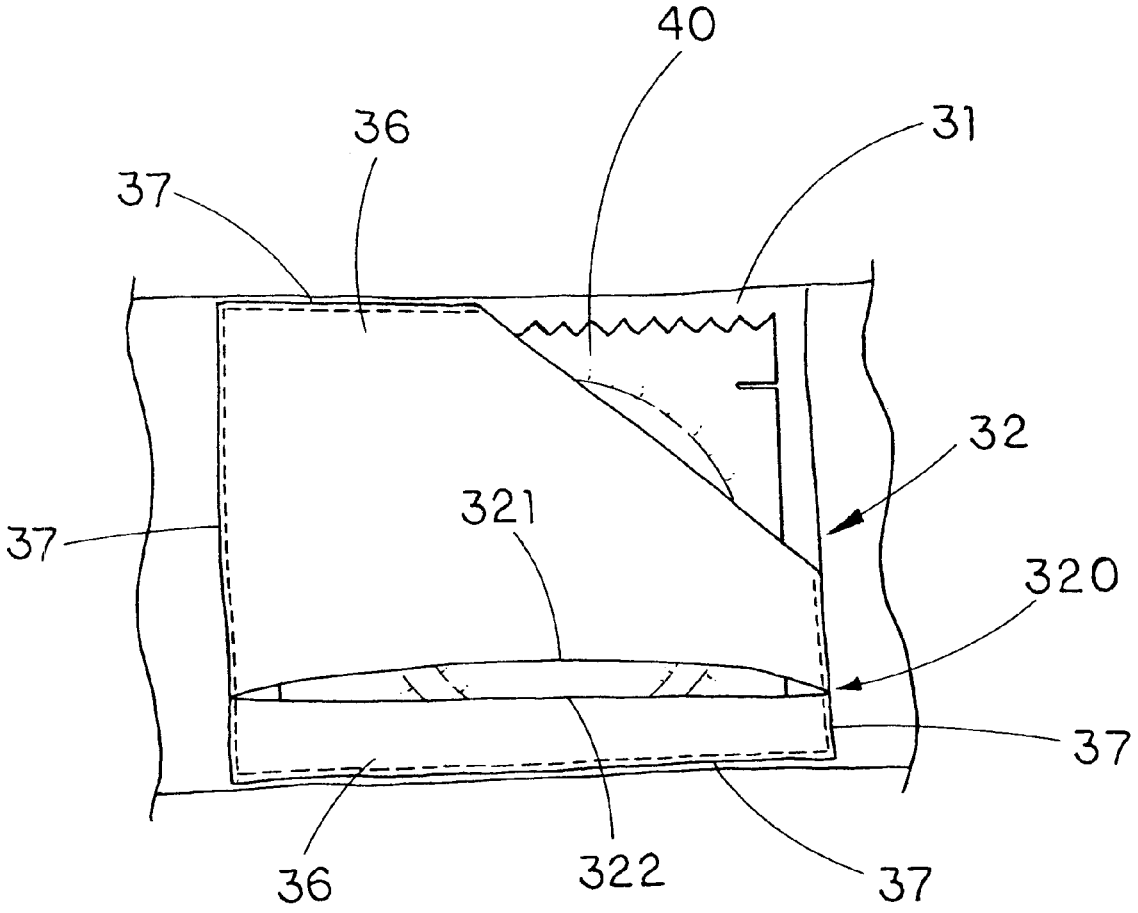
FIG. 9 a partial front view of the ankle holder illustrating a seventh alternative mode of the condom holder apparatus according to the above preferred embodiment of the present invention.
Figure 10:
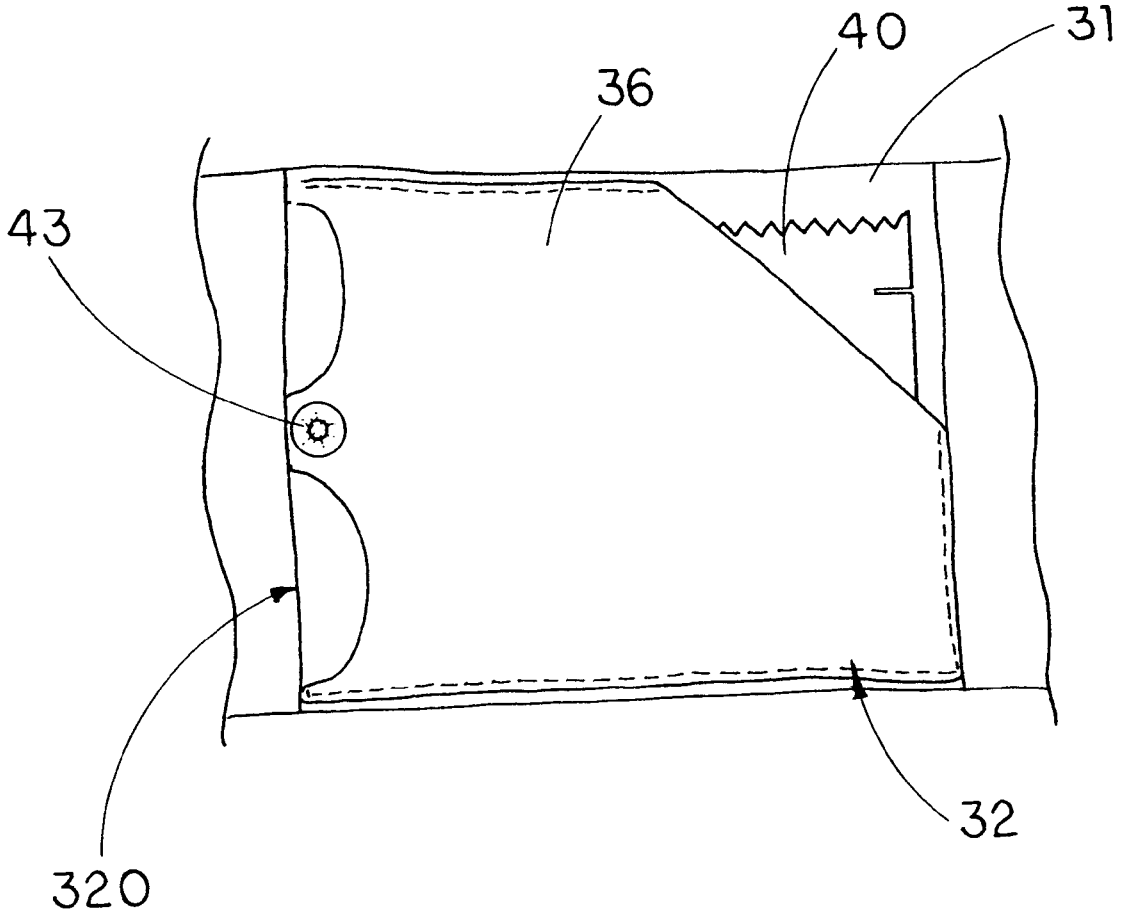
FIG. 10 is a partial front view of the ankle holder as shown in FIG. 5 with a fastening device which releasably connects one side of the panel to the strap.

For the third alternative mode of the condom holder apparatus as shown in FIG. 5, the pocket 32 of the condom holder apparatus 300 may further include a slit 320 in the panel 36, as illustrated in a seventh alternative mode as shown in FIG. 9, wherein two slit edges 321, 322 thereof are not attached to the strap 31. Consequently, new condom package 40 may be replaced into the pocket 32 through the slit 320. Preferably, the slit 320 runs horizontally, as shown in FIG. 9. However, the slit 320 can run vertically or in any other position. Furthermore, the slit 320 may be of any length and any width. Alternatively, as shown in FIG. 10, instead of a slit, one of the four sides 37 of the panel 36 can be releasably fixed to the strap 31 with a securing device 43. As a result, the condom package 40 can be inserted through the side with the securing device 43 when the securing device 43 is not engaged to connect the side to the strap 31. The securing device 43 can comprise of a button, a clip, hook and loop fasteners, or other similar fasteners.

Figure 11:
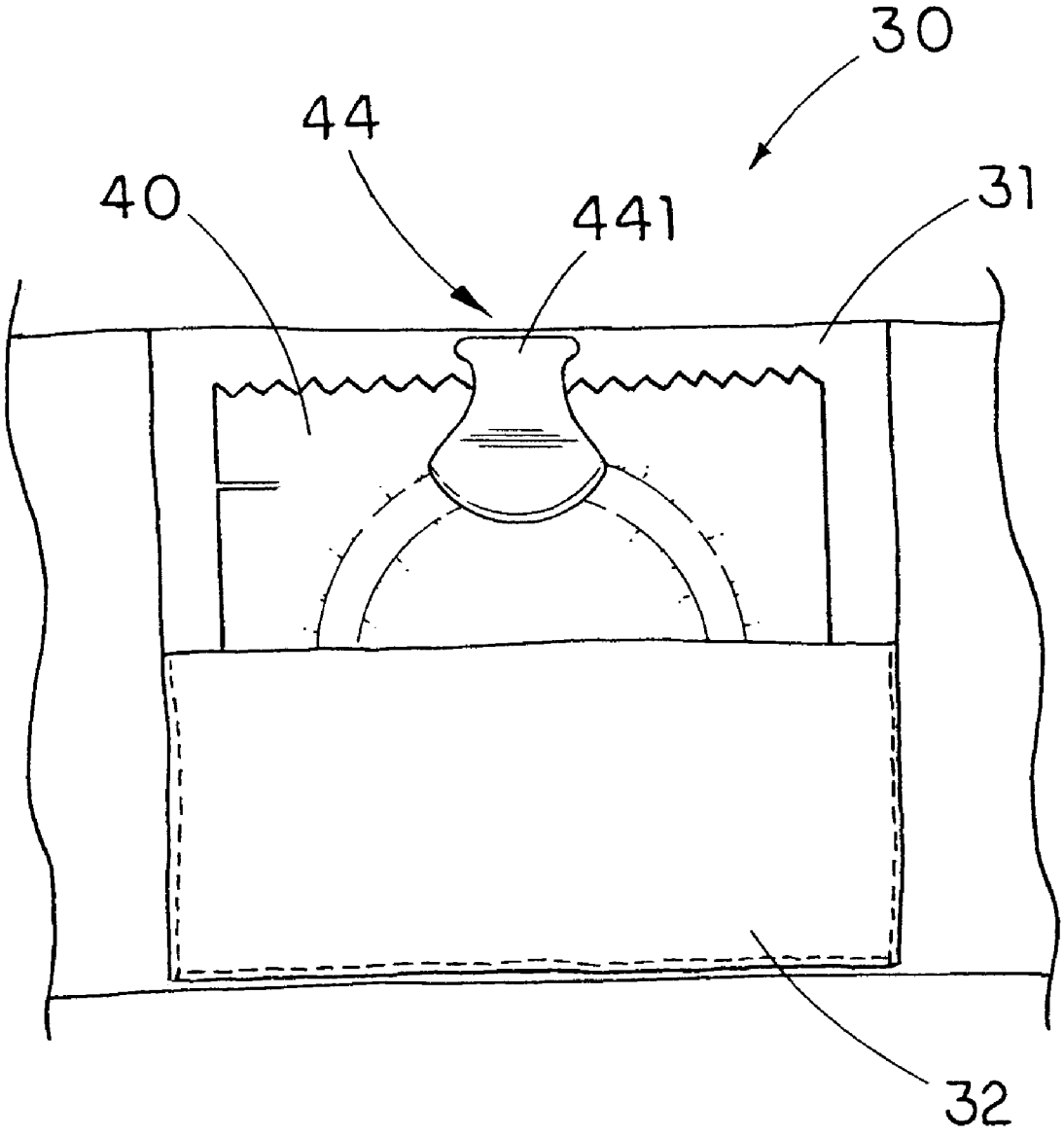
FIG. 11 a partial front view of the ankle holder illustrating an eighth alternative mode of the condom holder apparatus according to the above preferred embodiment of the present invention, illustrating the locking device that releasably secures the condom package in the pocket.
Figure 12:
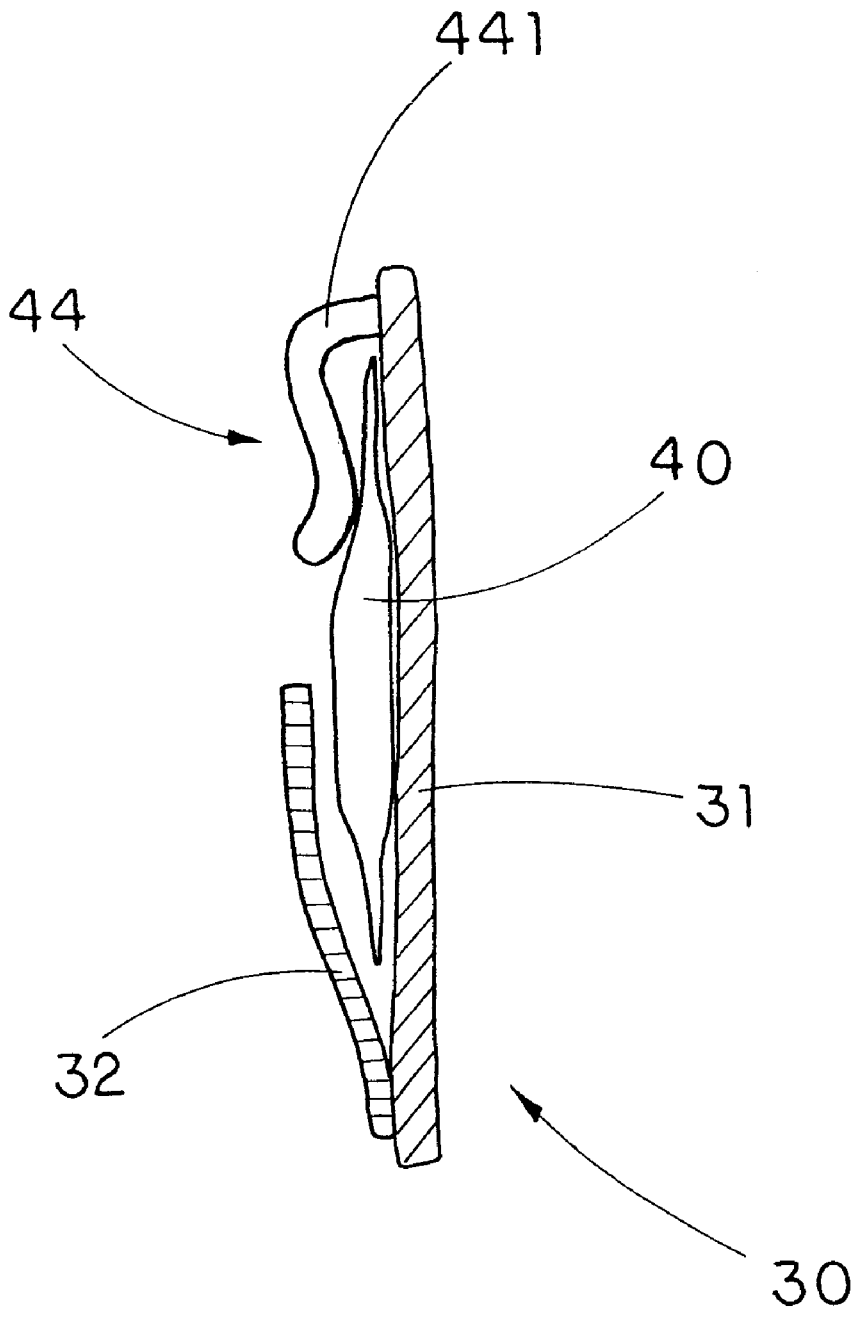
FIG. 12 illustrates a cross-sectional side view of the ankle holder of FIG. 11.

FIGS. 11 and 12 illustrate an eighth alterative mode of the condom holder apparatus 300 of the ankle holder 30 for condom packages according to the preferred embodiment of the present invention, wherein the ankle holder 30 can also include a locking device 44 which releasably secures the condom package 40 in the pocket 32. Preferably, the locking device 44, as shown in FIGS. 11 and 12, comprises a clip 441 which is attached to a top side of the strap 31. Certainly, the clip 441 can be in any position and can also be attached to the pocket 32 instead of the strap 31. The clip 441 is adapted to hold the condom package 40 in position wherein the condom package 40 slips into the clip 441. The pocket 32 exposes a portion of the condom package 40 whereby the condom package 40 may be opened while the condom package 40 is held in the pocket 32. Since the clip 441 secures the condom package 40 in the pocket 32, an individual can, with one hand, both open the condom package 40 by tearing a corner of the condom package 40 and then remove the condom out with the condom packaging bag remaining in the pocket 32.

Figure 13:
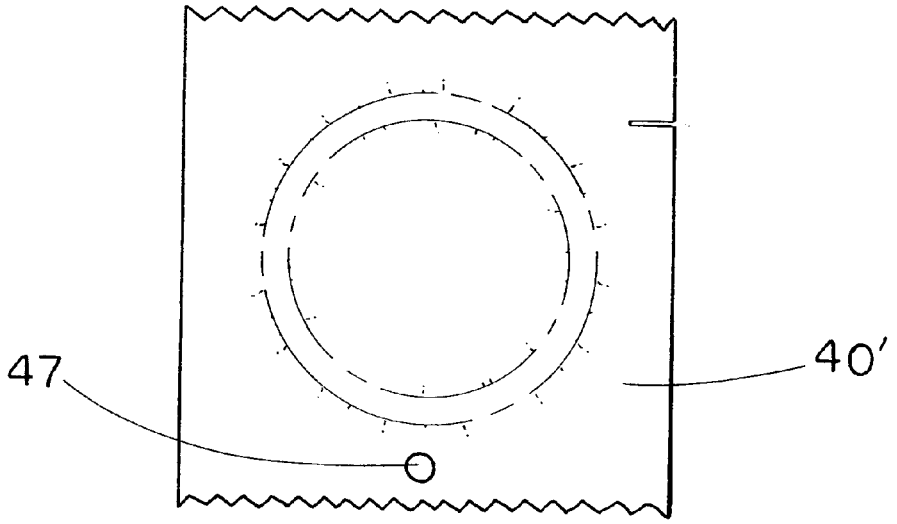
FIG. 13 is a front view of a condom package with a hole in its edge.
Figure 14:
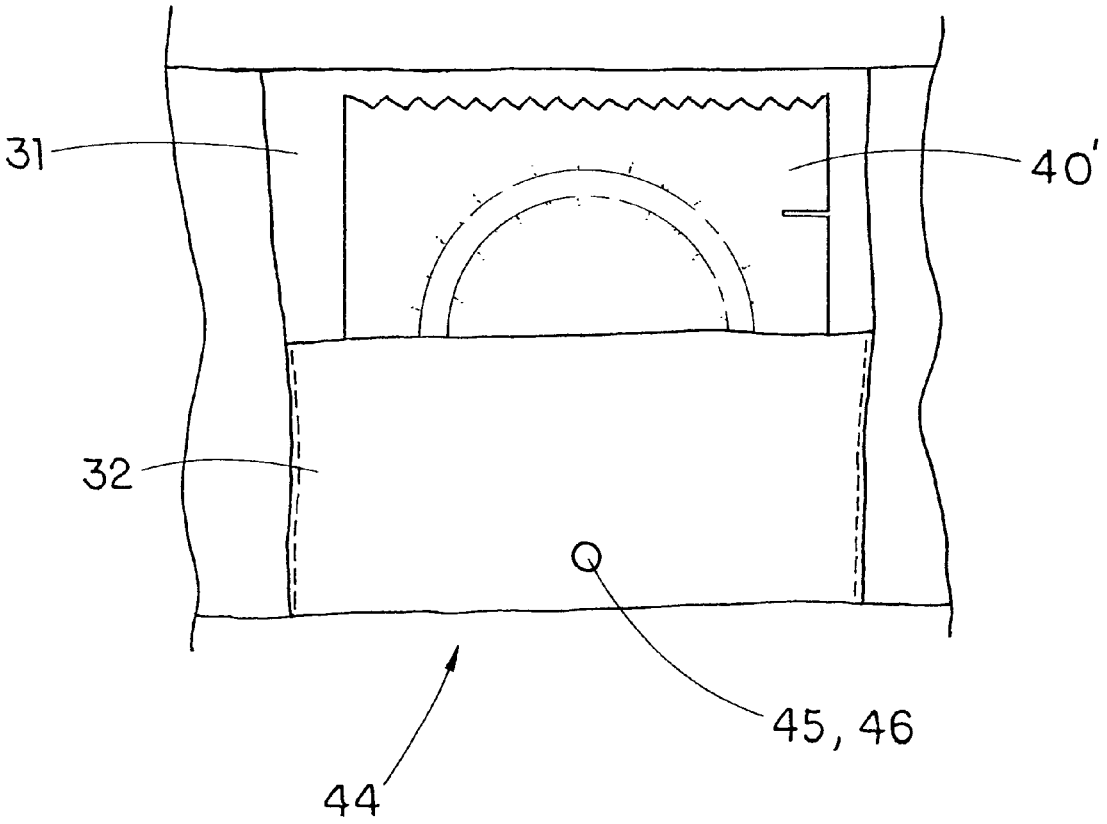
FIG. 14 a partial front view of the ankle holder illustrating a ninth alternative mode of the condom holder apparatus according to the above preferred embodiment of the present invention, illustrating the locking device that releasably secures the condom package in the pocket.
Figure 15:
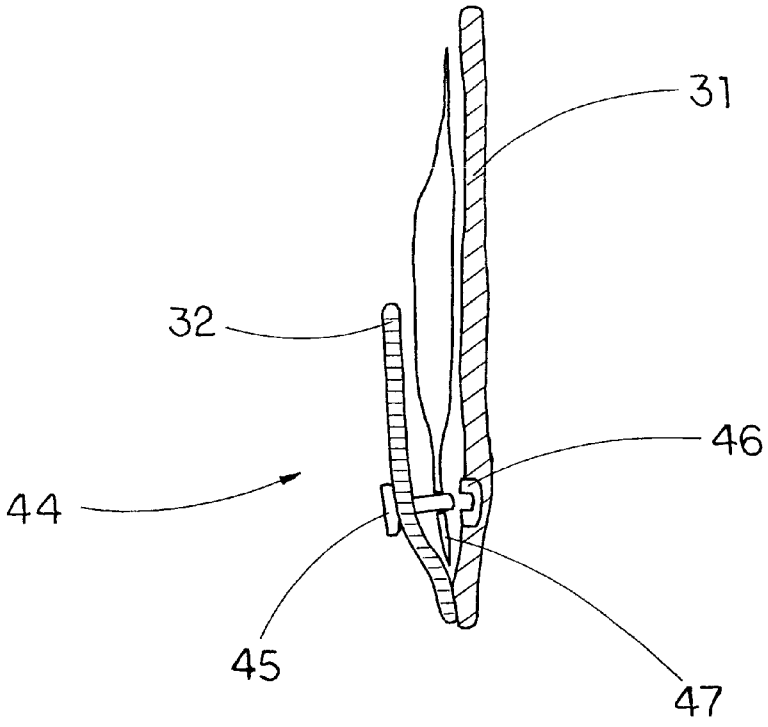
FIG. 15 is a cross-sectional side view illustrating the ankle holder as shown in FIG. 14.
Figure 16:
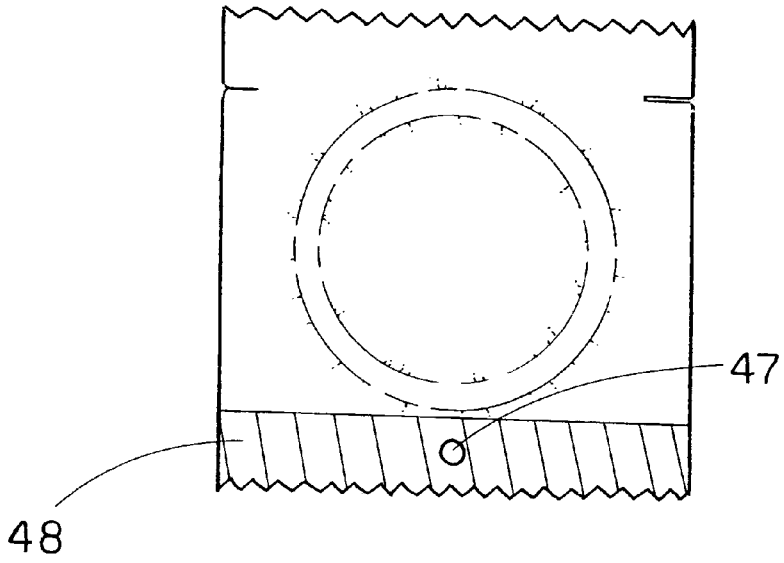
FIG. 16 is a front view of a plastic portion reinforcing the hole in the edge of a modified condom package.

FIGS. 13–15 show a ninth alternative mode of the condom holder apparatus, wherein an alternative mode of the locking device 44 is illustrated, wherein the locking device 44 is a button device comprising a protuberance 45 and a cap 46 shaped to releasably receive the protuberance 45. Preferably the protuberance 45 is affixed to the pocket 32 and the cap 46 is provided on the strap 31. Alternatively, the protuberance 45 can be affixed to the strap 31 and the cap 46 can also be attached to the pocket 32. The protuberance 45 is adapted to fit through a hole 47 provided at an edge of a condom package 40'. As a result, the button device traps the condom package 40' between the protuberance 45 and the cap 46. Since the condom package 40' is secured in the pocket 32, the wearer can tear open the condom package 40' by tearing a corner of the condom package 40' or by just pulling on the entire condom package 40'. As shown in FIG. 16, this embodiment can further include a modified condom package with a reinforced side 48. The reinforced side 48 strengthens the hole 47 and prevents the hole and the reinforced side from tearing. The reinforced side 48 may comprise a layer of foil, a layer of plastic, or other reinforcing materials.

Figure 17:
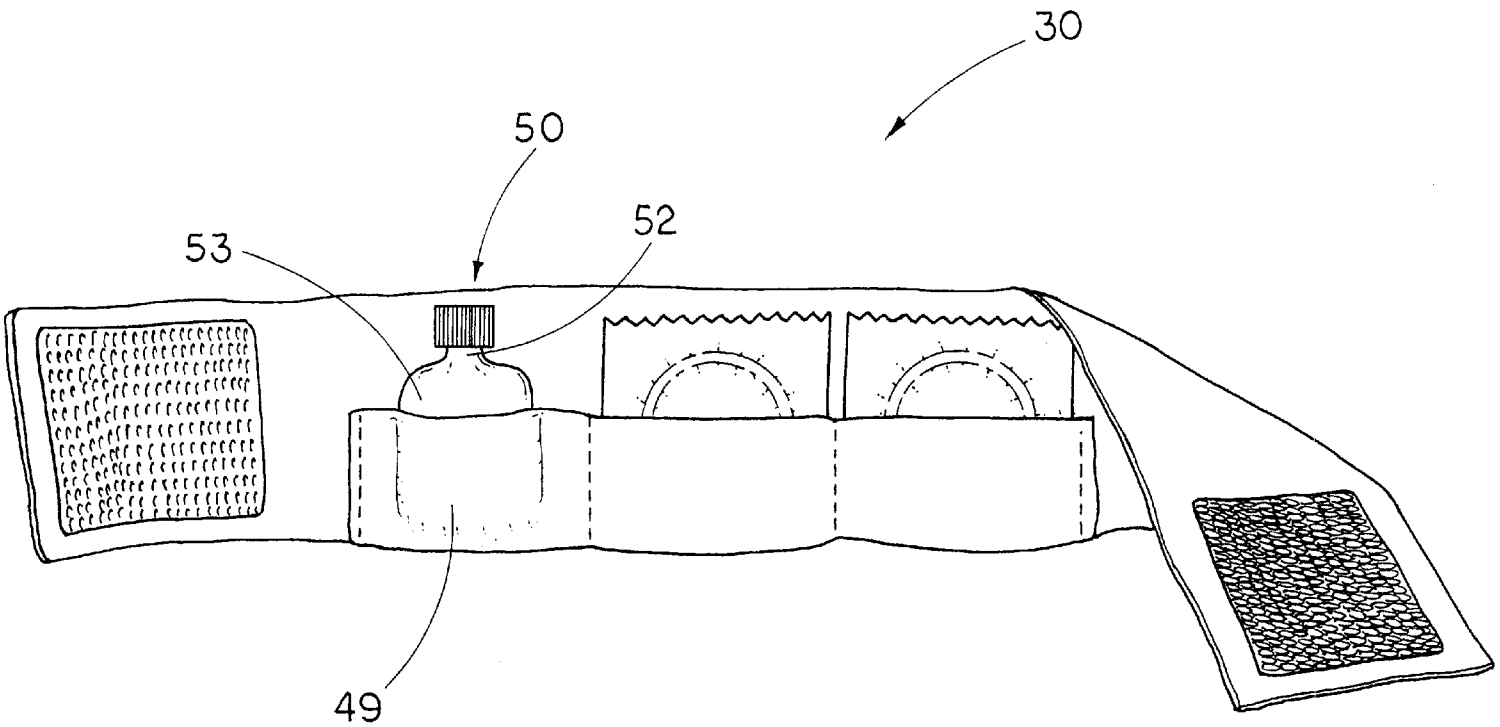
FIG. 17 is a perspective view of the ankle holder as shown in FIG. 2 with a pouch adapted to hold a bottle.
Figure 18:
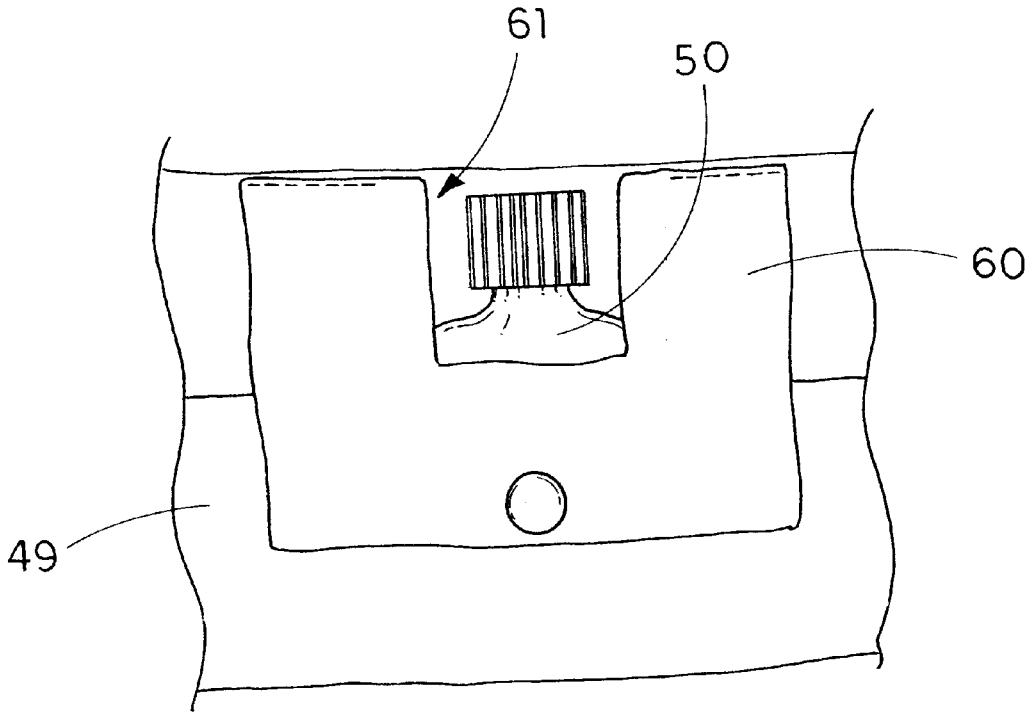
FIG. 18 is a front view illustrating in detail of the pouch as shown in FIG. 17 with a flap.

The ankle holder 30, as illustrated in FIG. 17, further includes a pouch 49 adapted to hold a bottle 50 of condom lubricant. As shown in FIG. 18, the pouch 49 may also include a flap 60 with a gap 61 in it which fits over a neck 52 of the bottle 50 but not the body 53 of the bottle 50. Therefore, the flap 60 releasably holds the bottle 50 in the pouch 49 and allows the wearer to access the bottle without removing the bottle 50 from the pouch 49.

In view of above, a user can fasten the ankle holder 30 to his or her ankle to carry the condom packages in a concealed and reachable manner. Normally, the ankle holder 30 is concealed by the pant and/or sock. However, the user can easily reach the ankle holder 30 and take out the condom from the condom packing bag with merely one hand. While the foregoing description and figures describe the preferred embodiments of the present invention, it should be appreciated that certain obvious modifications, variations, and substitutions may be made without departing from the spirit and scope of the present invention.

What is claimed is:

1. An ankle holder in combination with at least a condom package, comprising:

an elongated strap made of pliable material having a first opposite end and a second opposite end;

a fastening device comprising a first fastener and a second fastener affixed to said first opposite end and second opposite end respectively, so as to releasably couple said first opposite end with said second opposite end and render said strap in loop shape for attaching to an ankle position of a user; and a holder apparatus for releasably holding said condom package to said strap in such a manner that at least a portion of an edge of said condom package is exposed outside said holder apparatus comprising at least a pocket to receive said condom package therein and at least a locking device to releasably secure said condom package in said pocket, said pocket having a side opening to expose a side edge portion of said condom package, a side edge of said condom package providing a hole and said locking device comprising a protuberance and a cap shaped to releasably receive said protuberance, wherein said protuberance is affixed to said pocket and said cap is provided on said strap and is adapted to fit through said hole provided at said side edge of said condom package so as to trap said condom package between said protuberance and said cap.

2. An ankle holder in combination with at least a condom package, comprising:

an elongated strap made of pliable material having a first opposite end and a second opposite end;

a fastening device comprising a first fastener and a second fastener affixed to said first opposite end and second opposite end respectively, so as to releasably couple said first opposite end with said second opposite end and render said strap in loop shape for attaching to an ankle position of a user; and a holder apparatus for releasably holding said condom package to said strap in such a manner that at least a portion of an edge of said condom package is exposed outside, wherein said holder apparatus comprises at least a holder pocket which covers at least two corners of said condom package and exposes a portion of said condom package, and at least a locking device which releasably secures said condom package in said holder pocket, wherein a side edge of said condom package provides a hole and said locking device comprises a protuberance and a cap shaped to releasably receive said protuberance, wherein said protuberance is affixed to said holder pocket and said cap is provided on said strap, wherein said protuberance is adapted to fit through said hole provided at said side edge of said condom package so as to trap said condom package between said protuberance and said cap.

3. An ankle holder for carrying at least a condom package, comprising:

an elongated strap made of pliable material having a first opposite end and a second opposite end;

a fastening device comprising a first fastener and a second fastener affixed to said first opposite end and second opposite end respectively, so as to releasably couple said first opposite end with said second opposite end and render said strap in loop shape for attaching to an ankle position of a user;

a holder apparatus for releasably holding said condom package to said strap in such a manner that at least a portion of an edge of said condom package is exposed outside; and a pouch adapted to hold a bottle of condom lubricant, wherein said pouch includes a flap with a gap to fit over a neck of said bottle, so as to releasably hold said bottom in said pouch.

* * * * *